United States Patent [19]

Maenishi et al.

[11] Patent Number: 4,656,733

[45] Date of Patent: Apr. 14, 1987

[54] METHOD OF MANUFACTURE OF BASE ASSEMBLY FOR AN ELECTROMAGNETIC RELAY

[75] Inventors: Kozo Maenishi; Keiji Genma, both of Nagaokakyo; Takezo Sano, Shiga; Toshiki Tanaka, Ohtsu; Shigenobu Sato, Ohmi-Hachiman, all of Japan

[73] Assignee: Omron Tateisi Electronics Co., Kyoto, Japan

[21] Appl. No.: 838,521

[22] Filed: Mar. 11, 1986

Related U.S. Application Data

[62] Division of Ser. No. 772,026, Sep. 3, 1985.

[51] Int. Cl.[4] ..... H01H 11/06

[52] U.S. Cl. ..... 29/602 R; 29/622; 264/272.15

[58] Field of Search ..... 29/602 R, 622; 264/272.15; 335/80, 82, 95, 121, 129, 187, 190

[56] References Cited

U.S. PATENT DOCUMENTS 4,184,730 1/1980 Huebner ..... 29/602 R X
4,577,173 3/1986 Schedele et al. ..... 29/602 R X

*Primary Examiner*—Carl E. Hall

[57] ABSTRACT

This electromagnetic relay includes: a base assembly; an electromagnetic block assembly, mounted to the base, including an iron core and an electromagnetic coil wound around the core; a movable block assembly, which is selectively attracted by the electromagnetic block assembly according to energization of the electromagnetic coil thereof, and is movable along a direction perpendicular to the axial line of the iron core; a contact mechanism including a movable contact support member actuated by the movement of the movable block assembly, a movable contact mounted to the movable contact support member near one extremity thereof, a fixed terminal member supporting the movable contact support member from the base assembly near another extremity thereof, a fixed contact support member mounted to the base assembly opposing the movable contact support member, and a fixed contact mounted to the fixed contact support member opposing the movable contact; a means for guiding the movable block assembly along the aforesaid direction perpendicular to the axial line of the iron core; a projection formed on a surface of the movable block assembly facing the base assembly; and a guide projection wall, extending from the base assembly, along a surface formed on which the projection slides; the movable block assembly being engaged to be movable contact support member so as to be substantially fixed thereto with regard to mutual movement along the axial direction of the movable contact support member. Thereby, wobbling of the movable block assembly is prevented.

4 Claims, 9 Drawing Figures

METHOD OF MANUFACTURE OF BASE ASSEMBLY FOR AN ELECTROMAGNETIC RELAY

BACKGROUND OF THE INVENTION

This application is a divisional of Ser. No. 772,026, filed Sept. 3, 1985.

The present invention relates to the field of electromagnetic relays, and in particular to an electromagnetic relay in which a movable block assembly which actuates a contact mechanism is movable along a direction perpendicular to the axial line of the iron core of the relay.

Conventionally, there is a per se known form of electromagnetic relay in which a movable block which actuates a contact mechanism is movable along a direction perpendicular to the axial line of the iron core of the relay. Such a movable block, in the prior art, has been supported by being engaged to a movable contact member. This is done in order to minimize mechanical contact resistance. A problem with this has been that, as the movable block moves, it tends to wobble and to be woggled, i.e. undergoes slight rotary motion, as it moves along its proper direction of motion perpendicular to the axial line of the iron core of the relay. However, nowadays with the increasing demands for reduction in size and weight of electromagnetic relays, even a slight such wobbling motion of the movable block may cause the contact pressure of the contact mechanism to be altered, and may cause fluctuations in the amount of magnetic coupling between the movable block and an electromagnetic block of the relay including said iron core thereof, and this can produce the problem that accurate operating and restoring voltages are not maintained.

Another problem that has arisen with electromagnetic relays is the following. Typically, the movable block has driven a movable contact member so as to cause it to cooperate with a pair of fixed contact members which are provided as opposing to one another, for engagement and/or disengagement of contacts. However, again with the increasing demands for reduction in size and weight of electromagnetic relays which are being made nowadays, because of the tendency for the distance between the iron core of the relay and the contacts of the contact mechanism to change due to deformation in the base structure of the relay, such as for instance can be caused due to thermal stress, thereby the stroke of the motion of the movable block of the relay may be altered, and also the contact pressure of the contact mechanism has a tendency to change. According to this, again, the problem that accurate operating and restoring voltages are not maintained is exacerbated.

Further, if the distance between the iron core of the relay and the contacts of the contact mechanism is reduced in view of the desirability of making the relay more compact, then the distance available for providing electrical insulation between said iron core of the relay and said contacts of the contact mechanism is reduced.

Another problem with such an electromagnetic relay relates to its method of manufacture. When a fixed terminal piece supporting the aforementioned movable contact member and the aforementioned pair of fixed contact members which are to be provided as mounted to the base structure of the relay as opposing to one another, and when these members are formed from one sheet of metal with a so called lead frame and are then to be insert molded in said base structure of the relay, it is necessary to avoid opposing relationship other than between said contact members, and, as proposed for instance in Japanese Patent Laying Open Publication Ser. No. 56-143631 (1981), one of the fixed contact members can be provided sideways away from the longitudinal direction of the movable contact member, in relation to the other fixed contact member. If this fixed contact member is offset sideways in this manner, in a multiple pole type electromagnetic relay of the above described type in which the movable contact member is driven by a movable block, the problem arises that the fixed contact member tends to obstruct the movement of the movable block, and, in order to ensure sufficient space for the movement of the movable block, the fixed contact member must be mounted rather far towards the outside of the electromagnetic relay, thus creating the need to increase the space assigned thereto, and preventing the electromagnetic relay of this type from being acceptably compact.

Further, when the set distance between the electromagnetic block of the relay including the iron core thereof and the contact mechanism is reduced, for the purpose of reducing the overall size of the electromagnetic relay and increasing its compactness, an arc barrier wall must be provided as projecting outwards from the base assembly of the relay for insulating these members from one another, and it becomes difficult to form the arc barrier wall integrally with the base assembly at the same time as insert molding the movable contact member and the two fixed contact members together therewith, thus undesirably increasing the cost for manufacture of the electromagnetic relay.

SUMMARY OF THE INVENTION

Accordingly, it is the primary object of the present invention to provide an electromagnetic relay which overcomes the above outlined problems.

It is a further object of the present invention to provide such an electromagnetic relay which includes such a movable block, and in which said movable block is constrained to move only in its proper direction of motion.

It is a further object of the present invention to provide such an electromagnetic relay which includes such a movable block, and in which said movable block is prevented from undergoing any substantial wobbling or woggling motion.

It is a further object of the present invention to provide such an electromagnetic relay which has improved properties of activating and restoring voltages.

It is a further object of the present invention to provide such an electromagnetic relay which has a structure which prevents changes in the contact pressure of the contact mechanism thereof.

It is a further object of the present invention to provide such an electromagnetic relay which has a structure which prevents changes in the magnetic coupling between the movable block thereof and the electromagnetic block thereof including the iron core thereof.

It is a further object of the present invention to provide such an electromagnetic relay which has a structure which reduces positional fluctuations of the pole portion of said iron core thereof.

It is a further object of the present invention to provide such an electromagnetic relay which has a structure which maintains the distance between said iron core thereof and the contacts of the contact mechanism thereof.

It is a further object of the present invention to provide such an electromagnetic relay which has a structure which maintains good insulation between said electromagnetic block thereof including the iron core thereof and the contact mechanism thereof.

It is a further object of the present invention to provide such an electromagnetic relay which has a structure which maintains the distance between individual ones of the contacts of the contact mechanism thereof.

It is a further object of the present invention to provide such an electromagnetic relay which has a structure which reduces deformation of the base assembly structure thereof.

It is a further object of the present invention to provide such an electromagnetic relay which has a structure which tends to maintain the stroke of the motion of said movable block thereof as substantially constant.

It is a further object of the present invention to provide such an electromagnetic relay in which the contacts of the contact mechanism thereof may be easily positioned.

It is a further object of the present invention to provide such an electromagnetic relay in which the contacts of the contact mechanism thereof do not risk fouling the motion of said movable block thereof.

It is a further object of the present invention to provide such an electromagnetic relay in which an arc barrier wall for insulating between said electromagnetic block thereof including the iron core thereof and the contact mechanism thereof can be easily formed as integral with the base structure of the electromagnetic relay.

It is a yet further object of the present invention to provide such an electromagnetic relay which is compact.

It is a yet further object of the present invention to provide such an electromagnetic relay which is economical to manufacture.

It is a yet further object of the present invention to provide such an electromagnetic relay which is simple to assemble.

It is a yet further object of the present invention to provide such an electromagnetic relay which can be made by the use of a simple molding die.

It is a yet further object of the present invention to provide such an electromagnetic relay in which the individual contacts of the contact mechanism thereof are not required to be offset from one another.

It is a yet further object of the present invention to provide a method of manufacture for such an electromagnetic relay which helps with the attainment of at least some of the above objects the individual contacts of the contact mechanism thereof are not required to be offset from one another.

According to the most general aspect of the present invention, these and other objects are accomplished by an electromagnetic relay comprising: (a) a base assembly; (b) an electromagnetic block assembly, mounted to said base, comprising an iron core and an electromagnetic coil wound around said core; (c) a movable block assembly, which is selectively attracted by said electromagnetic block assembly according to energization of said electromagnetic coil thereof, and is movable along a direction perpendicular to the axial line of said iron core; (d) a contact mechanism comprising a movable contact support member actuated by the movement of said movable block assembly, a movable contact mounted to said movable contact support member near one extremity thereof, a fixed terminal member supporting said movable contact support member from said base assembly near another extremity thereof, a fixed contact support member mounted to said base assembly opposing said movable contact support member, and a fixed contact mounted to said fixed contact support member opposing said movable contact; (e) a means for guiding said movable block assembly along said direction perpendicular to said axial line of said iron core; (f) a projection formed on a surface of said movable block assembly facing said base assembly; and (g) a guide projection wall, extending from said base assembly, along a surface formed on which said projection slides; (h) said movable block assembly being engaged to said movable contact support member so as to be substantially fixed thereto with regard to mutual movement along the axial direction of said movable contact support member.

According to such a structure, by thus engaging said movable block assembly to said movable contact support member, by providing said means for guiding said movable block assembly along said direction perpendicular to said axial line of said iron core, and by providing said projection on said surface of said movable block assembly which slides along said guide projection wall, the movable block assembly is supported at three separate points which define a triangle or a tripodal support configuration, and accordingly its motion is definitely and positively restricted to be only in one direction, i.e. said direction perpendicular to said axial line of said iron core. Accordingly, said movable block assembly is constrained to move only in ito proper direction of motion, and is prevented from undergoing any substantial wobbling or woggling motion. Thus, there is provided an electromagnetic relay which has improved properties of activating and restoring voltages, and which has a structure which prevents changes in the contact pressure of the contact mechanism thereof, as well as preventing changes in the magnetic coupling between the movable block thereof and the electromagnetic block thereof including the iron core thereof. Accordingly, this electromagnetic relay has a structure which reduces positional fluctuations of the pole portion of said iron core thereof, and which maintains the distance between said iron core thereof and the contacts of the contact mechanism thereof.

Further, according to a more particular aspect of the present invention, these and other objects are more particularly and concretely accomplished by an electromagnetic relay of the structure outlined above, said iron core comprising a pole portion, wherein said guide projection wall bridges across a portion between said electromagnetic block assembly and said contact mechanism and said pole portion of said iron core, and serves as an arc barrier wall; said guide projection wall serving as said arc barrier wall further supporting a tip portion of said pole portion of said iron core; and optionally said guide projection wall may be formed in the general shape of a letter "L" or a letter "C".

According to such a structure, not only is the deformation of the base, for example deformation induced by thermal action, reduced by the stiffening effect provided by said guide projectdion wall—especially if said guide projection wall is formed in the general shape of a letter "L" or a letter "C"—but also positional fluctuations of the pole portion of said iron core of said electromagnetic relay are reduced, and the distance between said iron core and the contacts of the contact mechanism is maintained, by secure support of the tip portion of said iron core on said guide projection wall. Also, this structure maintains the distance between individual ones of the contacts of the contact mechanism, and reduces deformation of the base assembly structure, thus tending to maintain the stroke of the motion of said movable block assembly as substantially constant, and enabling the contacts of the contact mechanism to be easily positioned. Further, this electromagnetic relay has a structure which maintains good insulation between said electromagnetic block thereof including the iron core thereof and the contact mechanism thereof, by the interposing effect of said guide projection wall.

Further, according to a yet more particular aspect of the present invention, these and other objects are yet more particularly and concretely accomplished by an electromagnetic relay of the structure first outlined above, wherein said fixed terminal member and said fixed contact support member are integrally mounted to said base assembly by insert molding in such a way that the root end of said fixed contact support member does not get in the way of the movement of said movable block assembly; further said base assembly comprises an arc barrier wall by opposing said fixed terminal member and said fixed contact support member to one another; and further comprising a second fixed contact support member, supporting a second fixed contact, mounted to said base assembly so as to oppose said first fixed contact support member; and further, optionally and desirably, said second fixed contact support member may be non integrally mounted to said base assembly.

According to such a structure, because said fixed terminal member and said first fixed contact support member are integrally mounted to said base assembly by insert molding, while said second fixed contact support member is separately, and may be non integrally, mounted to said base assembly, and the structure is such that the root end of said fixed contact support member does not get in the way of the movement of said movable block assembly, thereby the space not occupied by said root end of said fixed contact support member is effectively utilized, thereby aiding with the compactness of the electromagnetic relay. Further, since only one of the two fixed contact support members needs to be integrally formed with the base assembly by insert molding, it becomes simpler to form an arc barrier wall on the base assembly, and the molding die for forming the structure is simplified, which aids with simplification of manufacture and accordingly with reduction of cost. Further, since the second fixed contact support member is fixedly secured to the base assembly, either at the time of molding said base assembly or separately, the assembly of the fixed contact support members is simplified.

Further, according to a method aspect of the present invention, these and other objects are yet more particularly and concretely accomplished by a method of forming a base assembly for an electromagnetic relay, comprising the steps, in the specified order, of: (a) forming from a metal plate a lead frame with, connected thereto by connecting portions: a fixed terminal member for, when said relay is assembled, supporting in a cantilever fashion a movable contact support member by its one end; a first fixed contact support member, adjacent on said lead frame to said fixed terminal member, for, when said relay is assembled, supporting a first fixed contact for cooperating with a movable contact fixed to the free end of said movable contact support member; and a second fixed contact support member, for, when said relay is assembled, supporting a second fixed contact for cooperating with said movable contact fixed to said free end of said movable contact support member; (b) insert molding said fixed terminal member and said first fixed contact support member to said base assembly, and forming an arc barrier wall on said base assembly; (c) cutting away some of the connecting portions which support said second fixed contact support member; (d) bending back, along a line on a non cut away one of said connecting portions, said second fixed contact support member, so that it opposes said first fixed contact support member; (e) fixing said second fixed contact support member to said base assembly; and (f) cutting free said second fixed contact support member.

According to such a method, because, after the fixed terminal member and the first fixed contact support member are insert molded to the base assembly, the other second fixed contact support member is bent back to a position where it opposes said first fixed contact support member, before it is fixed to the base assembly, thereby the two fixed contact support members may be placed as opposing one another without being offset sideways from one another. This makes for easy and compact construction of the base assembly. Further, since only one of the fixed contact support members which oppose one another is integrally formed with the base assembly by insert molding, it becomes easier and simpler to form the arc barrier wall on said base assembly, and the molding die becomes simplified, with attendant reduction in manufacturing cost and simplification of manufacture. Also, since the other fixed contact piece is fixedly secured to the base assembly, either at the same time as the molding of said base assembly or separately, the assembly of the fixed contact pieces is made easier.

BRIEF DESCRIPTION OF THE DRAWINGS

The present invention will now be shown and described with reference to the preferred embodiments of the device and of the method thereof, and with reference to the illustrative drawings. It should be clearly understood, however, that the description of these embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood as referring to the orientation on the drawing paper of the relevant figure or figures and not in any absolute sense unless particularly so qualified; and:

DESCRIPTION OF THE PREFERRED EMBODIMENTS

Figure 1:
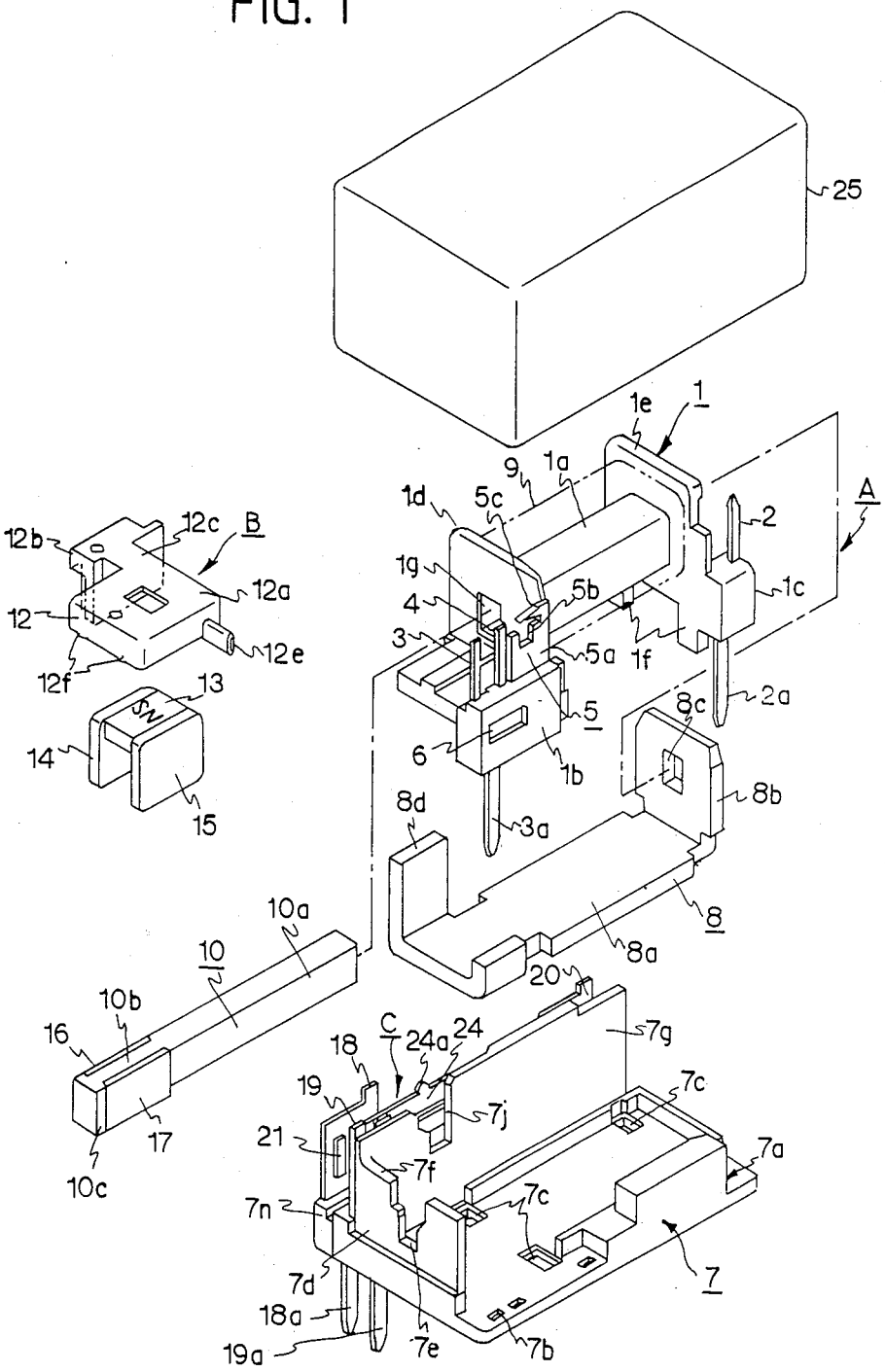
FIG. 1 is an exploded perspective view of the preferred embodiment of the electromagnetic relay according to the device aspect of the present invention.
Figure 2:
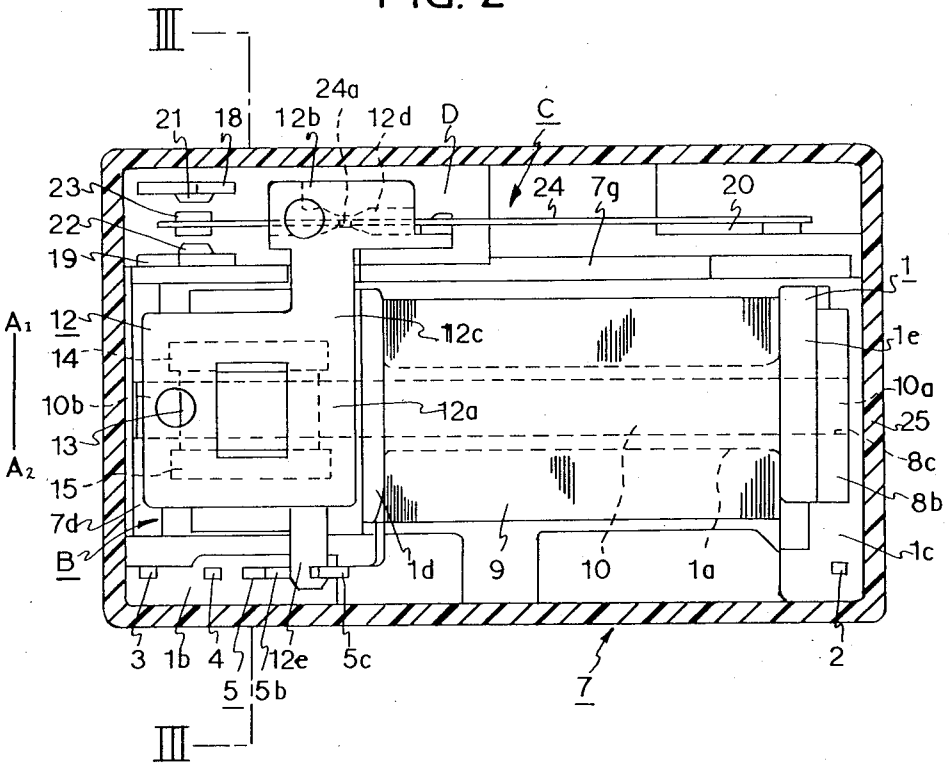
FIG. 2 is a plan view of said preferred embodiment as seen through its cover.
Figure 3:
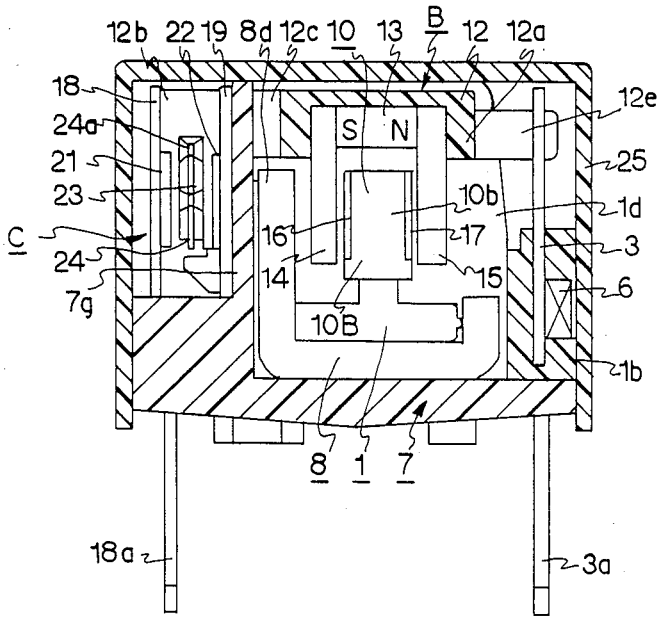
FIG. 3 is a sectional view of said preferred embodiment taken in a plane shown by the arrows III—III in FIG. 2.

The present invention will now be desribed with reference to the preferred embodiments of the device and of the method thereof, and with reference to the appended drawings. FIG. 1 shows the preferred embodiment of the electromagnetic relay of the present invention in exploded perspective view, while FIG. 2 shows a plan view of said preferred embodiment as seen through its cover 25 and FIG. 3 is a sectional view of said preferred embodiment taken in a plane shown by the arrows III—III in FIG. 2. This relay comprises an electromagnetic block assembly A, a movable block assembly B, a base assembly generally denoted by the reference numeral 7, a contact assembly C mounted to said base assembly 7, and said cover 25. The electromagnetic block assembly A is also mounted to the base assembly 7, and selectively moves the movable block assembly B to selectively actuate the contact assembly C, the whole being covered over by the cover C for exclusion of moisture and the like.

The electromagnetic block assembly A comprises a coil spool assembly 1, a yoke member 8, and a rod shaped iron core assembly 10. The coil spool assembly 1 comprises a central shaft portion 1*a* formed with a central bore 1*g*, and flange portions 1*d* and 1*e* are integrally formed at the two ends of this central shaft portion 1*a*. These flange portions 1*d* and 1*e* respectively are provided with terminal holder members 1*b* and 1*c*. The terminal holder member 1*b* is provided with two coil terminals 3 and 4, fitted to it and secured by insert molding, and likewise the other terminal holder member 1*c* is provided with a coil terminal 2, likewise fitted to it and secured by insert molding. The lower portions 2*a* and 3*a* respectively of the coil terminals 2 and 3 project downwardly from the lower sides of the terminal holder members 1*c* and 1*b* respectively to the outside of the base assembly 7, to define connecting terminal portions for selective supply of electrical energy from a source external to the electromagnetic relay to a coil 9 as will be explained hereinafter. A bearing assembly 5, more particularly described later in this specification, extends upwards from the upper side of the terminal holder member 1*b*.

Figure 4:
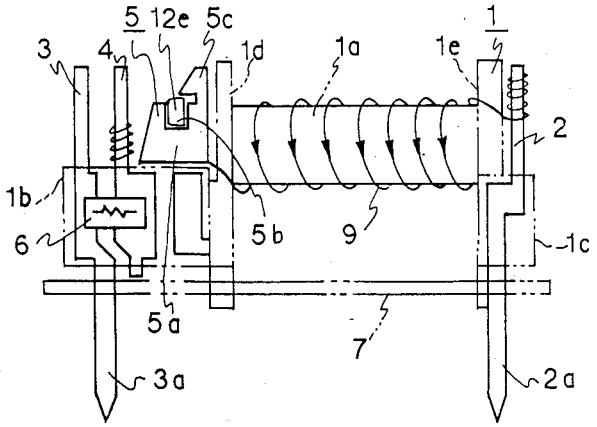
FIG. 4 is a schematic side view of an electromagnetic block assembly of said preferred embodiment, particularly showing how it is mounted to a base assembly thereof which is partially shown by double dotted lines.

FIG. 4 is a schematic side view of the electromagnetic block assembly A, particularly showing how it is mounted to the base assembly 7 which is partially shown by double dotted lines. As shown in this figure, a chip resistor 6 is fitted by insert molding to said terminal holder member 1*b* and connects the coil terminals 3 and 4 together with a certain electrical resistance therebetween. A plurality of projections 1*f* are formed on the lower sides in FIG. 1 of the flange portions 1*d* and 1*e*, and these are fitted into corresponding depressions 7*c* formed in the base assembly 7 for locating the electromagnetic block assembly A thereon, with the yoke member 8 sandwiched between said electromagnetic block assembly A and said base assembly 7; the ends of these projections 1*f* sticking out on the other side of said base assembly 7 are thermally crimped, for securing the electromagnetic block assembly A and the yoke member 8 in a predetermined position on said base assembly 7. Thus, the base portion 8*a* of the yoke member 8 is positively positioned by being held between the projections 1*f* of the flange portions 1*d* and 1*e* on either side thereof, and further is held between the lower surfaces of said flange portions 1*d* and 1*e* and the upper surface of the base assembly 7. Further, the lower connecting terminal portions 2*a* and 3*a* respectively of the coil terminals 2 and 3 project downwardly through the base assembly 7, as shown in FIG. 4, to extend to the outside of the electromagnetic relay for electrical connection thereto.

On the upper surface of the base assembly 7 there are integrally formed two arc barriers or walls 7*d* and 7*g*. The arc barrier 7*g* is formed as lying along one side of the electromagnetic block assembly A when said electromagnetic block assembly A is fitted to the base assembly 7 as explained above, and interposes between said electromagnetic block assembly A and the contact assembly C which will be described hereinafter. And this arc barrier 7*g* is formed with a depression 7*j* for receiving a neck portion 12*c* of a movable table member 12 which will be described later of the movable block assembly D. Thus, the movable table member 13 is slidably supported by its neck 12*c* being fitted into said depression 7*j*. Further, the other arc barrier 7*d* is formed as extending substantially perpendicularly from one end of the above described arc barrier 7*g*, lying along one end of the electromagnetic block assembly A when said electromagnetic block assembly A is fitted to the base assembly 7 as explained above, and is formed with a depression 7*e* for receiving the end 10*c* of the pole portion 10*b* of the rod shaped iron core assembly 10 for fixedly holding and positioning it. The other end portion 10*a* of said rod shaped iron core assembly 10 is passed through the central bore 1*g* of the central shaft portion 1*a* of the coil spool assembly 1 and is fixedly crimped to an upwardly projecting piece 8*a* of the yoke member 8. Thereby, the iron core assembly 10 is held securely in its place as shown in FIGS. 2 and 3. And an electromagnetic coil 9, only shown in FIG. 1 by dot dashed lines, is fitted around said central shaft portion 1*a* of the coil spool assembly 1, with its ends, as schematically shown in FIG. 4, electrically connected to the coil terminals 2 and 4.

The movable block assembly B comprises the movable table member 12, shaped as best shown in FIGS. 1 and 2, a permanent magnet member 13 secured to the underside of the main base portion 12*a* of said table member 12, and two armature members 14 and 15 secured to opposite pole edges of said permanent magnet member 13 and projecting downwards away from said main base portion 12*a* of said table member 12 as shown in FIG. 3 in cross section. When the movable block assembly B is mounted as will be described shortly, the armature member 14 is located between a one 16 of two shield plates 16 and 17 which are mounted on either side of the aforementioned pole portion 10*b* of the rod shaped iron core assembly 10 and an upwardly projecting piece 8*d* of the yoke member 8, while the other armature member 16 opposes the other one 17 of said two shield plates 16 and 17.

Figure 5:
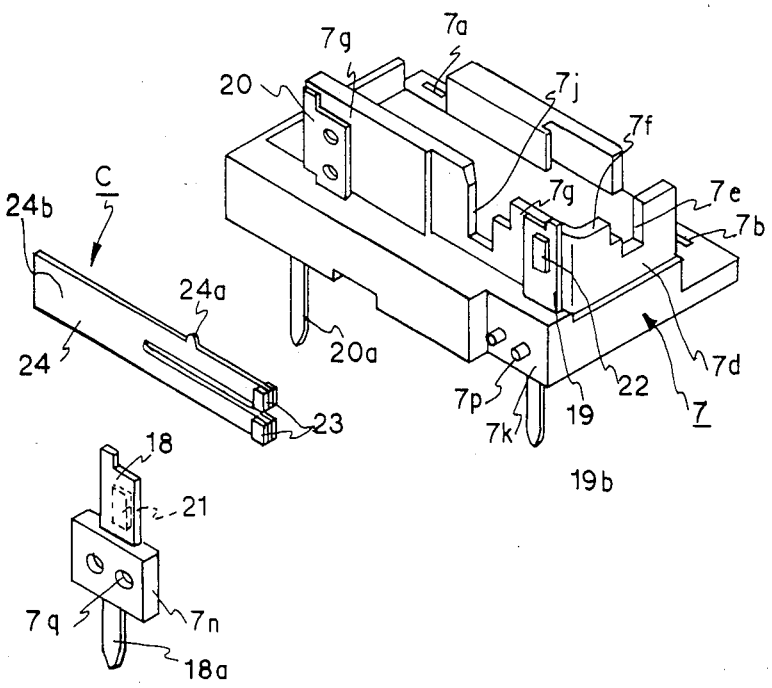
FIG. 5 is an exploded perspective view of the base assembly of the electromagnetic relay, for illustrating how a contact mechanism is assembled thereto.

The contact assembly C is provided on the other side of the arc barrier wall 7*g* from the electromagnetic block assembly A, as previously mentioned, and comprises, as best seen in the plan view of FIG. 2 and the exploded perspective view of FIG. 5: a springy longitudinally extended strip shaped electrically conductive movable contact support member 24, to the free end of which are fixed two movable contacts 23, and which is formed with an engagement projection 24*a* extending upwards from an approximately central portion of its upper edge and is supported by its base portion 24*b* remote from said movable contacts 23 in a cantilever fashion from a terminal member 20 fixedly mounted to the base assembly 7 of the electromagnetic relay; a fixed contact support member 18 which is fixedly mounted to said base assembly 7 on one side of the aforesaid movable contacts 23 and bears a fixed contact 21; and another fixed contact support member 19 which is fixedly mounted to said base assembly 7 on the other side of the aforesaid movable contacts 23 and bears another fixed contact 22. Further, the lower portions 18*a* and 19*a* respectively of the fixed contacts 18 and 19 and the lowe portion 20*a* of the terminal member 20 project downwardly through the base assembly 7 (as shown in FIG. 5) to provide connecting terminal portions which extend to the outside of the electromagnetic relay for electrical connection thereto.

Now, the way in which this movable block assembly B is mounted to the electromagnetic relay of this invention will be particularly described: in fact, as will be seen, this block assembly B is so mounted as to be movable in the transverse direction of the electromagnetic relay indicated by the arrows A1–A2 in FIG. 2 (hereinafter referred to as the direction of motion), but so as not to be wobblable or wogglable sideways to any substantial extent in any direction perpendicular to said direction of motion. The aforesaid main base portion 12*a* of the table member 12 is provided with a projecting shaft portion 12*e* extending along the direction of motion, and further has two small projections 12*f* on its under side from the point of view of FIG. 1. And the previously mentioned neck portion 12*c* of the table member 12 joins said main base portion 12*a* thereof to a contact engagement portion 12*b* thereof. The underside of this contact engagement portion 12*b* is formed with an engagement groove 12*d* which has a small depression formed in its bottom, said engagement groove 12*d* extending in the direction parallel to the movable contact support member 24. Thus, when the device is assembled: the two small projections 12*f* on the under side of the main base portion 12*a* of the table member 12 slide on the upper plane surface 7*f* of the arc barrier wall 7*d*, one resting on one side of the depresseion 7*e* therein which holds the end of the iron core assembly 10 and the other resting on the other side of said depression 7*e;* the neck portion 12*c* is slidably engaged in the depression 7*j* of the other arc barrier wall 7*g;* and the projecting shaft portion 12*e* is slidably engaged into a depression 5*b* formed in a bearing member 5*a* comprised in the bearing assembly 5; this depression 5*b* has an open top, and the bearing assembly 5 further comprises a retaining projection 5*c* which extends in the direction for partially closing said open top of said depression 5*b*, so that during assembly the projecting shaft portion 12*e* is approached towards and inserted into the depresseion 5*b* from above by pressing said retaining projection 5*c* out of the way by bending it somewhat, and is thereafter prevented from coming out of said depression 5*b* by the retaining projection 5*c*. And, further, when the device is assembled, the upper edge of the movable contact support member 24 is engaged into the aforesaid engagement groove 12*d* formed in the contact engagement portion 12*b* of the table member 12, with the engagement projection 24*a* of said movable contact support member 24 fitted into the aforementioned small depression formed in the bottom of said engagement groove 12*d*. The positions (a) of the two small projections 12*f*, (b) of the engagement point between the projecting shaft portion 12*e* and the depression 5*b* of the bearing assembly 5, and (c) of the small depression formed in the bottom of the engagement groove 12*d* into which the engagement projection 24*a* is fitted, approximately define an equilateral trapezium; and, considering only one of said small projections 12*f*, its position (a) together with the position (b) of said engagement point between the projecting shaft portion 12*e* and the depression 5*b* of the bearing assembly 5 and the position (c) of the small depression formed in the bottom of the engagement groove 12*d* into which the engagement projection 24*a* is fitted, mutually define a triangle.

As a modification to the shown structure, there could be provided, for the bearing assembly 5, an upwardly projecting plate with a hole formed through it, and the projecting shaft portion 12*e* could merely slide in this hole. Such a construction would have the advantage of simplicity, over the construction outlined above and shown in FIGS. 1 and 4, but would have worse assemblability.

In FIG. 5 there is shown an exploded perspective view of the base assembly 7, for illustrating how the contact mechanism C is assembled thereto. This shows that the terminal member 20 and the fixed contact support member 19 are integrally molded into the base assembly 7 during its manufacture, while on the other hand the other fixed contact support member 18 is integrally molded into a mounting member 7*n* during its manufacture, said mounting member 7*n* then being fitted into a notched shape 7*k* formed on the base assembly 7 and being secured thereto by projections 7*p* in said notched shape 7*k* being inserted into and through holes 7*q* formed through said mounting member 7*n* and being crimped over, for example by thermal crimping. Thereby, the terminal member 20 supporting the movable contact support member 24 bearing the movable contacts 23 and the fixed contact support member 19 bearing the fixed contact 22 are integrally molded into the base assembly 7 and, as shown in FIG. 5, are intimately and integrally pressed against the arc barrier wall 7*g* thereof, while the fixed contact support member 18 bearing the fixed contact 21 is somewhat spaced away from said arc barrier wall 7*g* and is opposed to said fixed contact support member 19 bearing the fixed contact 22 with the movable contacts 23 being interposed between them. However, as an alternative method of forming this contact mechanism C as assembled to the base assembly 7, it would be possible first to integrally mold the terminal member 20 and the fixed contact support member 19 bearing the fixed contact 22 to said base assembly 7 by insert molding, and subsequently to insert the fixed contact support member 18 bearing the fixed contact 21 into the notched shape 7*k* formed on the base assembly 7 and to perform another act of insertion molding again. A method of forming this base assembly 7, according to the preferred embodiment of the method aspect of the present invention, will be particularly described later in this specification.

Now, the operation of the electromagnetic relay with the above described structure, and the peculiar advantages thereof, will be explained.

The position of the device shown in FIGS. 2 and 3 is a neutral state thereof, which cannot in fact be stably attained during its operation. In the non activated state of this electromagnetic relay in which no actuating electrical power is being supplied from the outside via the downwardly projecting lower connecting terminal portions 2*a* and 3*a* respectively of the coil terminals 2 and 3 to the electromagnetic coil 9, said electromagnetic coil 9 is exerting no magnetic force, and accordingly the iron core assembly 10 and the yoke member 8 are not themselves exerting any substantial magnetomotive force of their own. Thus, in this condition, the magnetic flux produced by the permanent magnet member 13 passes in a loop into and through the armature member 15, the iron core assembly 10, the yoke member 8, and the upwardly projecting place 8*d* of the yoke member 8, to pass into the other armature member 14 and back to the permanent magnet member 13. As a result, the movable block assembly B including said permanent magnet member 13 and said armature members 14 and 15 is displaced to the left from the position shown in FIG. 3, i.e. is displaced upwards in FIG. 2 in the direction indicated by the arrow A1, so that the armature member 14 is moved as close as allowed within the physical constraints provided to said upwardly projecting piece 8*d* of the yoke member 8, and so that the other armature member 15 is approached to the pole portion 10*b* of the rod shaped iron core assembly 10, or rather to the shield plate 17 thereof, so as to minimize the magnetic resistance of said magnetic flux path. In this position of the movable block assembly B, the movable contact support member 24 is moved to the left from the position shown in FIG. 3, i.e. is displaced upwards in FIG. 2 in the direction indicated by the arrow A1, so that the movable contacts 23 are definitely brought away from the fixed contact 22 borne on the fixed contact support member 19 and are moved so that one of said movable contacts 23 is brought into contact with the other fixed contact 21 borne on the other fixed contact support member 18, and thereby the lower connecting terminal portion 20*a* of the terminal member 20 is brought to be in electrical connection with the lower connecting terminal portion 18*a* of the fixed contact 18 but to be out of electrical connection with the other lower connecting terminal portion 19*a* of the other fixed contact 19.

On the other hand, when actuating electrical power is supplied from the outside via the downwardly projecting lower connecting terminal portions 2*a* and 3*a* respectively of the coil terminals 2 and 3 to the electromagnetic coil 9, then, in this new condition of the apparatus, said electromagnetic coil 9 is caused to exert a certain considerable magnetic force which, in the aforementioned magnetic flux circuit, acts oppositely to the magnetic force of the permanent magnet member 13. In particular, the iron core assembly 10 and the yoke member 8 are so magnetized that the armature member 14 is attracted to the pole portion 10*b* of the rod shaped iron core assembly 10 on the side of the shield plate 16 thereof, thus causing the movable block assembly B including said permanent magnet member 13 and said armature members 14 and 15 to be displaced to the right from the position shown in FIG. 3, i.e. downwards in FIG. 2 in the direction indicated by the arrow A2, so that the armature member 14 is moved as far as allowed within the physical constraints provided from said upwardly projecting piece 8*d* of the yoke member 8, and so that the other armature member 15 is brought away from the pole portion 10*b* of the rod shaped iron core assembly 10, or rather from the shield plate 17 thereof. As this movement from the previously described non activated state of the electromagnetic relay occurs, the projecting shaft portion 12*e* of the table member 12 slides in the depression 5*b* formed in the bearing member 5*a* comprised in the bearing assembly 5, the two small projections 12*f* on the under side of the main base portion 12*a* of said table member 12 slide on the upper plane surface 7*f* of the arc barrier wall 7*d*, one on either side of the depression 7*e* therein, and the neck portion 12*c* of said table member 12 slides in the depression 7*j* of the other arc barrier wall 7*g*; and, further, since the upper edge of the movable contact support member 24 is engaged into the aforesaid engagement groove 12*d* formed in the contact engagement portion 12*b* of the table member 12, with the engagement projection 24*a* of said movable contact support member 24 fitted into the aforementioned small depression formed in the bottom of said engagement groove 12*d*, thereby this side of the table member 12 is firmly supported during the motion of said table member 12, and cannot wobble in any direction perpendicular to the direction of motion of said table member 12 (the direction A1–A2 in FIG. 2). In the final displaced position of the movable block assembly B, the movable contact support member 24 is moved so that the movable contacts 23 are brought away from the fixed contact 21 borne on the fixed contact support member 18 and are moved so that one of said movable contacts 23 is brought into contact with the other fixed contact 22 borne on the other fixed contact support member 19, and thereby the lower connecting terminal portion 20*a* of the terminal member 20 is now brought to be in electrical connection with the lower connecting terminal portion 19*a* of the fixed contact support member 19 but to be out of electrical connection with the other lower connecting terminal portion 18*a* of the other fixed contact support member 18. Thus, the electromagnetic relay of this invention is switched over. And, further, when the coil 9 is energized in the opposite direction, the electromagnetic relay switches over again to its previously defined state, and is restored in the direction indicated in FIG. 2 by the arrow A1, again.

Thus, by the operation as explained above of the electromagnetic relay according to the preferred embodiment of the present invention, because there is provided the projecting shaft portion 12*e* on the table member 12 which is slidingly engaged in the depression 5*b* formed in the bearing member 5*a* comprised in the bearing assembly 5, and because further there are provided the two small projections 12*f* on the under side of the main base portion 12*a* of said table member 12 which are arranged to slide on (for example) the upper plane surface 7*f* of the arc barrier wall 7*d*, and because yet further there is provided the engagement groove 12*d* formed in the contact engagement portion 12*b* of the table member 12, with the engagement projection 24*a* of the movable contact support member 24 fitted into the small depression formed in the bottom of said engagement groove 12*d*, thereby the table member 12, and the movable block assembly B as a whole, are supported at three positions (and in fact at four points), so as to be allowed to move, substantially only, in the preferred direction of movement as indicated in FIG. 2 by the arrows A1–A2, perpendicular to the axial direction of the iron core assembly 10. Thereby, wobbling and woggling of said movable table member 12 during its motion for switching over the electromagnetic relay of the present invention is prevented, and this means that fluctuations in the contact pressure of the contact assembly C are prevented, and also fluctuations in the magnetic coupling between the movable block assembly B and the electromagnetic block assembly A are prevented, and thus the actuating and restoring voltage properties of the electromagnetic relay according to the present invention are made to be outstanding.

Now, in the electromagnetic relay according to the shown preferred embodiment of the present invention, the arc barrier walls *7g* and *7d* are formed as extending in the general shape of a letter "L" across the top of the base assembly 7, between the electromagnetic block assembly A with the iron core assembly 10 and the contact assembly C, thus defining a guide projection wall structure, and because not only is the possibility of deformation under stress (especially thermal stress) of the base assembly 7 reduced by the stiffening effect of this wall structure, but also the tip portion 10*c* of the pole portion 10*b* of the iron core assembly 10 is supported by the arc barrier wal *7g*, thereby, positional fluctuations of said pole portion 10*b* of the iron core assembly 10 are reduced and/or prevented, which means that the distance from the side of said pole portion 10*b* to the contact assembly C is kept substantially constant, which, again, means that fluctuations in the contact pressure of the contact assembly C are prevented by prevention in changes of the moving stroke of the movable block assembly B, thus improving further the actuating and restoring voltage properties of the electromagnetic relay according to the present invention.

Further the arc barrier walls *7g* and *7d*, since they extend across the top of the base assembly 7 in the general shape of a letter "L" between the electromagnetic block assembly A with the iron core assembly 10 and the contact assembly C, thereby improve the electrical insulation effect between the electromagnetic block assembly A and the contact assembly C, thus improving the electrical characteristics of the electromagnetic relay according to the present invention. Also, since the terminal member 20 and the fixed contact support member 19 are intimately formed with the arc barrier wall *7g* on the base assembly 7, even if a stress (such as a thermal stress) which would deform said base assembly 7 is applied, nevertheless the positions of said terminal member 20 and said fixed contact support member 19 remain fixed due to the stiffening effect of the arc barrier wall *7g*, and thus, again, fluctuations in the contact pressure of the contact assembly C are prevented.

Although in the shown preferred embodiment of the relay according to the present invention the arc barrier walls *7g* and *7d* were formed as extending in the general shape of a letter "L" across the top of the base assembly 7, in another possible construction said walls could extend in the general shape of a square letter "C", i.e. in the shape of three sides of a square or rectangle. Such a construction would have the merits outlined above, as well as, perhaps, its own peculiar and particular advantages.

Now, with reference to FIGS. 6A through 6D, the preferred embodiment of the method according to the present invention for forming the base assembly 7 of this electromagnetic relay will be explained.

Figure 6A:
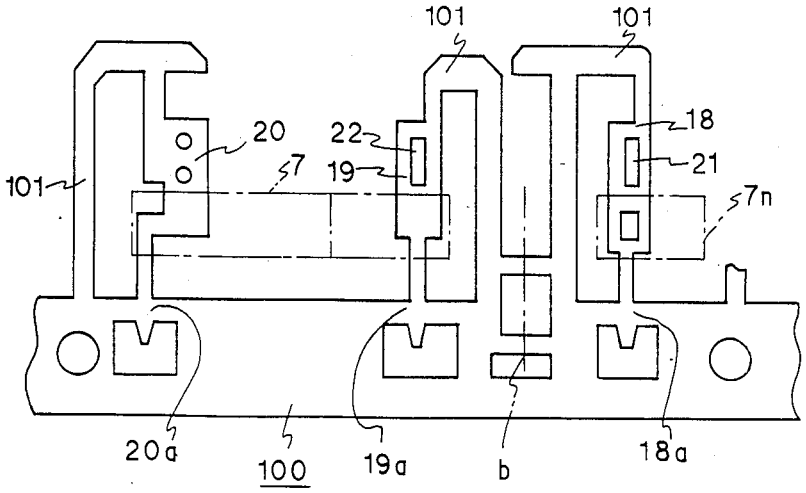
FIG. 6, which has four subfigures designated as 6A through 6D, is a set of figures illustrating the preferred embodiment of the method according to the present invention for making the base assembly of the electromagnetic relay shown above.

FIG. 6A shows the form of a so called lead frame 100, from which the fixed contact support members 18 and 19 and the terminal member 20 are formed: in fact, this lead frame 100 is a stamping made from a metal sheet, and as schematically shown on either side of FIG. 6A could be continued for constructing several examples of this electromagnetic relay. The lead frame 100 has a base portion and several bracing portions 101, which support the portions of the lead frame 100 which will become the fixed contact support member 18 with its connecting terminal portion 18*a* and with the contact 21 thereon, the fixed contact support member 19 with its connecting terminal portion 19*a* and with the contact 22 thereon, and the terminal member 20 with its connecting terminal portion 20*a*. These portions of the lead frame 100 which will become these members of the finished base assembly 7 are designated, in FIGS. 6A through 6D, by the same reference numerals as those members, for the convenience of explanation.

This lead frame 100 is inserted into a mold die (not particularly shown in the drawings), and, as schematically shown in FIG. 6A by the dot dashed lines, the fixed contact support member 19 with its connecting terminal portion 19*a* and the terminal member 20 with its connecting terminal portion 20*a* are insert molded to the base 7 of the electromagnetic relay, i.e. to their positions as shown in FIG. 5, while simultaneously the fixed contact support member 18 with its connecting terminal portion 18*a* is also insert molded to the mounting member *7n* therefor, as also shown in FIG. 5.

Figure 6B:
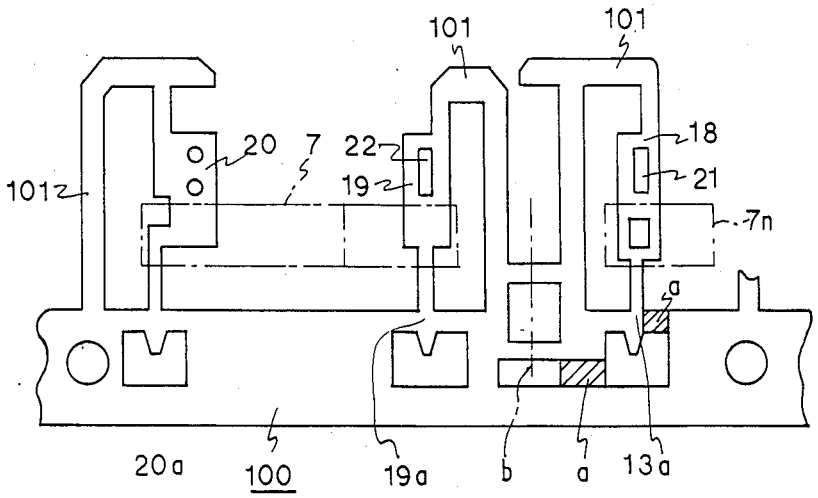

Next, as shown in FIG. 6B, portions designated as "a" of the lead frame 100 are cut away, so as to partially free the fixed contact support member 18 with its connecting terminal portion 18*a* and the mounting member *7n* to which it has been insert molded as described above, and so as to define one side of said connecting terminal portion 18*a*.

Figure 6C:
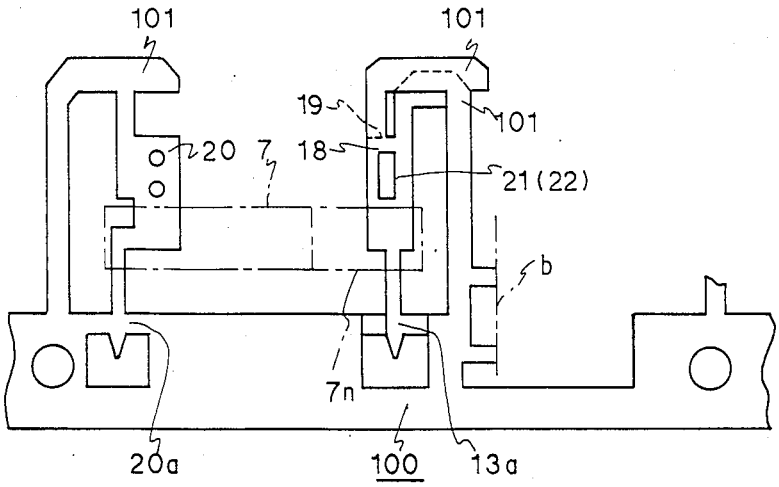

And next, as shown in FIG. 6C, the lead frame 100 is folded along the line designated by "b", so that, from the point of view of the drawing, the fixed contact support member 18 with its connecting terminal portion 18*a* and the mounting member *7n* to which it has been insert molded are brought in front of the fixed contact support member 19 with its connecting terminal portion 19*a* which have been already insert molded to the base assembly 7, so that the contacts 21 and 22 on these support members 18 and 19 oppose one another with a certain gap being interposed between them, and so that the mounting member *7n* is brought to fit into the notched shape *7k* formed on the base assembly 7, as previously described, with the projecting portions *7p* in said notched shape *7k* being inserted into and through the holes *7q* formed through said mounting member *7n*, as described above and suggested in FIG. 5. And then the projections *7p* are crimped over by thermal crimping, so as firmly to secure the mounting member *7n* into the notched shape *7k* of the base assembly 7, and so as to secure the fixed contact support member 18 with its connecting terminal portion 18*a* in its position as opposing the fixed contact support member 19 with its connecting terminal portion 19*a*.

Figure 6D:
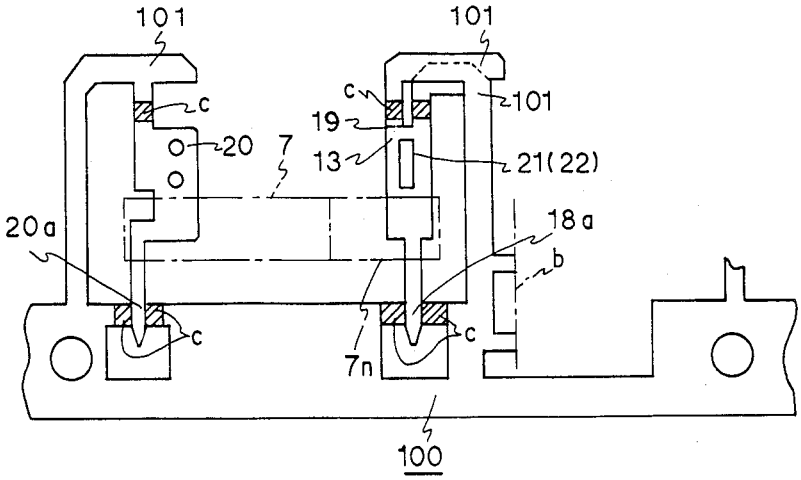

Finally, as shown in FIG. 6D, portions designated as "c" of the lead frame 100 are cut away, so as to finish freeing the fixed contact support member 18 with its connecting terminal portion 18*a*, so as to define the other side of said connecting terminal portion 18*a*, and so as to free the fixed contact support member 19 and the terminal member 20 and so as to define their connecting terminal portions 19*a* and 20*a*. Thereby, the FIG. 5 structure is conveniently completed.

As an alternative method of construction, however, it would be possible to perform the process of manufacture of the base assembly 7 without using any mounting member such as the mounting member 7*n*. In such an alternative method, in a first step only the fixed contact support member 19 with its connecting terminal portion 19*a* and the terminal member 20 with its connecting terminal portion 20*a* are insert molded to the base 7 of the electromagnetic relay, i.e. to their positions as shown in FIG. 5, while on the other hand no molding process is performed for the fixed contact support member 18 with its connecting terminal portion 18*a*. After this step, next as shown in FIG. 6B the same portions designated as "a" of the lead frame 100 are cut away, so as to partially free the fixed contact support member 18 with its connecting terminal portion 18*a*, and so as to define one side of said connecting terminal portion 18*a*. Next, as shown in FIG. 6C, the lead frame 100 is folded along the same line as before designated by "b", so that, from the point of view of the drawing, the fixed contact support member 18 with its connecting terminal portion 18*a* are brought in front of the fixed contact support member 19 with its connecting terminal portion 19*a* which have been already insert molded to the base assembly 7, somewhat inserted into the notched shape 7*k* of said base assembly 7, so that the contacts 21 and 22 on these support members 18 and 19 oppose one another with a certain gap being interposed between them. Next, by another insert molding step, this fixed contact support member 18 is insert molded to the base assembly 7, so as to secure the fixed contact support member 18 with its connecting terminal portion 18*a* in its position as opposing the fixed contact support member 19 with its connecting terminal portion 19*a*. And finally, as shown in FIG. 6D, the same portions designated as "c" of the lead frame 100 are cut away, so as to finish freeing the fixed contact support member 18 with its connecting terminal portion 18*a*, so as to define the other side of said connecting terminal portion 18*a*, and so as to free the fixed contact support member 19 and the terminal member 20 and so as to define their connecting terminal portions 19*a* and 20*a*. Thereby, a structure analogous to the FIG. 5 structure (but slightly different therefrom) is conveniently completed.

In either of the constructions described above, since the space, generally designated in FIG. 2 by the reference symbol D, through which the contact engagement portion 12*b* of the table member 12 moves does not include the root portion of the fixed contact support member 19 with the fixed contact 22 thereon, therefore this space D may be conveniently and effectively utilized for the motion of said contact engagement portion 12*b* of said table member 12, and accordingly the compact design of the electromagnetic relay is effectively promoted.

Because the fixed contact support member 19 with its connecting terminal portion 19*a* and the terminal member 20 with its connecting terminal portion 20*a* are integrally insert molded into the base 7 of the electromagnetic relay, i.e. to their positions as shown in FIG. 5, while, even although the arc barrier wall 7*g* is projectingly provided to said base assembly 7, the fixed contact support member 18 with its connecting terminal portion 18*a* and the fixed contact 21 is separately secured to said base assembly 7, thereby the structure of the molding die for this securing process is simplified, with consequent reduction in the complexity of manufacture and accordingly of the cost for manufacture. Additionally, since the fixed contact support member 18 with its connecting terminal portion 18*a* and the fixed contact 21 is secured to the base assembly 7, either in the same step or in a separate step as securing the other fixed contact support member 19 with its connecting terminal portion 19*a* and the terminal member 20 with its connecting terminal portion 20*a* to said base assembly 7, thereby the assembly of said fixed contact support member 18 with its connecting terminal portion 18*a* and the fixed contact 21 and of said other fixed contact support member 19 with its connecting terminal portion 19*a* and the fixed contact 22 to the base assembly is simplified.

Because, after the terminal member 20 with its connecting terminal portion 20*a* and the pair of fixed contact support members 18 and 19 with their connecting terminal portions 18*a* and 19*a* are formed from one piece of sheet metal along with the lead frame 100 and the bracing portions 101, and after the terminal member 20 with its connecting terminal portion 20*a* and one of the fixed contact support members 19 with its connecting terminal portion 19*a* are fixed to the base assembly 7 by insert molding, then the other one of said fixed contact support members 18 with its connecting terminal portion 18*a* is bent back (along the line designated as "b" in FIG. 6B) and is brought to oppose said one of the fixed contact support members 19 with its connecting terminal portion 19*a*, thereby these two fixed contact support members 18 and 19 may be brought to oppose one another without offsetting either of them sideways from the longitudinal axial line of the movable contact support member 24, and thereby, again, the compact design of the electromagnetic relay is effectively promoted.

Although the present invention has been shown and described with reference to the preferred embodiments of the device and of the method thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A method of forming a base assembly for an electromagnetic relay, comprising the steps, in the specified order, of:

(a) forming from a metal plate a lead frame with, connected thereto by connecting portions: a fixed terminal member for, when said relay is assembled, supporting in a cantilever fashion a movable contact support member by its one end; a first fixed contact support member, adjacent on said lead frame to said fixed terminal member, for, when said relay is assembled, supporting a first fixed contact for cooperating with a movable contact fixed to the free end of said movable contact support member; and a second fixed contact support member, for, when said relay is assembled, supporting a second fixed contact for cooperating with said movable contact fixed to said free end of said movable contact support member;

(b) insert molding said fixed terminal member and said first fixed contact support member to said base assembly, and forming an arc barrier wall on said base assembly;

(c) cutting away some of the connecting portions which support said second fixed contact support member;

(d) bending back, along a line on a non cut away one of said connecting portions, said second fixed contact support member, so that it opposes said first fixed contact support member;

(e) fixing said second fixed contact support member to said base assembly; and (f) cutting free said second fixed contact support member.

2. A method of forming a base assembly for an electromagnetic relay according to claim 1, wherein a depression is formed in said base assembly, and, in step (e), said second fixed contact support member is insert molded to be integral with said base assembly, after having been, in step (d), bent back to be fitted into said depression.

3. A method of forming a base assembly for an electromagnetic relay according to claim 1, wherein: a depression is formed in said base assembly; before step (c), said second fixed contact support member is insert molded to be integral with a block member which is separate from said base assembly; said block member is, in step (d), carried around with said bending of said connecting portion, so as to be fitted into said depression; and, subsequently to step (d), said block member is fixedly secured to said base assembly in said depression thereof.

4. A method of forming a base assembly for an electromagnetic relay according to claim 1, wherein said first fixed contact support member which is integrally molded to said base assembly is fixedly supported by said arc barrier wall.

* * * * *